US007387556B1

(12) United States Patent
Davis

(10) Patent No.: US 7,387,556 B1
(45) Date of Patent: Jun. 17, 2008

(54) EXHAUST SYSTEM FOR A MARINE PROPULSION DEVICE HAVING A DRIVESHAFT EXTENDING VERTICALLY THROUGH A BOTTOM PORTION OF A BOAT HULL

(75) Inventor: Richard A. Davis, Mequon, WI (US)

(73) Assignee: Brunswick Corporation, Lake Forest, IL (US)

( * ) Notice: Subject to any disclaimer, the term of this patent is extended or adjusted under 35 U.S.C. 154(b) by 59 days.

(21) Appl. No.: 11/364,957

(22) Filed: Mar. 1, 2006

(51) Int. Cl.
*B63H 20/00* (2006.01)
*B63H 23/36* (2006.01)

(52) U.S. Cl. ..... 440/89 A; 440/112

(58) Field of Classification Search ..... 440/89 R
See application file for complete search history.

(56) References Cited

U.S. PATENT DOCUMENTS

| | | | | |
|---|---|---|---|---|
| 4,178,873 | A | 12/1979 | Bankstahl | 115/73 |
| 4,526,002 | A | 7/1985 | Bibow | 60/293 |
| 4,601,666 | A | 7/1986 | Wood | 440/89 |
| 4,773,215 | A | 9/1988 | Winberg et al. | 60/324 |
| 4,834,683 | A | 5/1989 | Govan | 440/89 |
| 4,891,025 | A | 1/1990 | Brandt | 440/66 |
| 4,911,666 | A * | 3/1990 | Gage et al. | 440/89 R |
| 4,927,390 | A | 5/1990 | Kudoh et al. | 440/88 |
| 4,940,434 | A | 7/1990 | Kiesling | 440/57 |
| 5,108,325 | A | 4/1992 | Livingston et al. | 440/112 |
| 5,212,949 | A | 5/1993 | Shiozawa | 60/298 |
| 5,352,141 | A | 10/1994 | Shields et al. | 440/80 |
| 5,403,216 | A | 4/1995 | Salmi et al. | 440/6 |
| 5,423,701 | A | 6/1995 | Rodskier et al. | 440/81 |
| 5,441,432 | A | 8/1995 | Rodskier et al. | 440/89 |
| 5,735,718 | A | 4/1998 | Ekwall | 440/83 |
| 5,755,605 | A | 5/1998 | Asberg | 440/75 |
| 5,857,880 | A | 1/1999 | Harada | 440/89 |
| 5,954,554 | A | 9/1999 | Bates | 440/89 |
| 6,439,937 | B1 | 8/2002 | Mansson et al. | 440/75 |
| 6,582,259 | B1 | 6/2003 | Mansson et al. | 440/75 |
| 6,623,320 | B1 | 9/2003 | Hedlund | 440/80 |
| 6,638,124 | B2 | 10/2003 | Zoubul et al. | 440/89 |
| 6,705,907 | B1 | 3/2004 | Hedlund | 440/51 |
| 6,783,410 | B2 | 8/2004 | Florander et al. | 440/51 |
| 7,186,157 | B2 * | 3/2007 | Mansson et al. | 440/89 R |

FOREIGN PATENT DOCUMENTS

| | | |
|---|---|---|
| WO | WO 03/093106 | 4/2003 |
| WO | WO 03/903105 | 4/2003 |

* cited by examiner

*Primary Examiner*—Jesús D Sotelo
(74) *Attorney, Agent, or Firm*—William D. Lanyi

(57) ABSTRACT

An exhaust system for a marine propulsion device directs a flow of exhaust gas from an engine located within the marine vessel, and preferably within a bilge portion of the marine vessel, through a housing which is rotatable and supported below the marine vessel. The exhaust passageway extends through an interface between stationary and rotatable portions of the marine propulsion device, through a cavity formed in the housing, and outwardly through hubs of pusher propellers to conduct the exhaust gas away from the propellers without causing a deleterious condition referred to as ventilation.

21 Claims, 12 Drawing Sheets

EXHAUST SYSTEM FOR A MARINE PROPULSION DEVICE HAVING A DRIVESHAFT EXTENDING VERTICALLY THROUGH A BOTTOM PORTION OF A BOAT HULL

CROSS REFERENCE TO CO-PENDING PATENT APPLICATION

This patent application is generally related to co-pending patent application (M09993) which was filed by Bradley et al. on Oct. 12, 2005 (Ser. No. 11/248,483), co-pending patent application (M09992) which was filed by Bradley et al. on Oct. 12, 2005 (Ser. No. 11/248,482), co-pending patent application (1636-00569) which was filed by Davis on Oct. 21, 2005 (Ser. No. 11/255,718), and co-pending patent application (1636-00570) which was filed by Davis et al. on Oct. 21, 2005 (Ser. No. 11/255,510), which are assigned to the assignee of this patent application.

BACKGROUND OF THE INVENTION

1. Field of the Invention

The present invention is generally related to a marine propulsion system having a vertical driveshaft extending through the generally horizontal wetted surface of a submerged hull and, more particularly, to an exhaust system that directs exhaust gas from an engine within the bilge, or hull structure, of a marine vessel downwardly through the hull of the marine vessel and to a position that allows the exhaust stream to pass through the hub of a propeller of the marine propulsion device.

2. Description of the Related Art

U.S. Pat. No. 5,108,325, which issued to Livingston et al. on Apr. 28, 1992, discloses a boat propulsion device that mounts through a hole in a bottom surface of a boat. The engine is positioned inside the boat and the propeller drive is positioned under a bottom surface of the boat. The propulsion device includes a mounting assembly, a steering assembly rotatably connecting the drive to the mounting assembly for steering the propeller drive under the boat, a trimming assembly swingingly connecting the drive to the steering assembly for trimming/tilting of the propeller drive under the boat at any steered position, and a driveshaft means providing a drive connection between the engine and the propeller drive at any steered and trimmed position.

U.S. Pat. No. 5,735,718, which issued to Ekwall on Apr. 7, 1998, describes a drive unit for a boat having an engine with a flywheel surrounded by a flywheel casing, a propeller drive housing connected to, but electrically insulated from, the flywheel casing, and an input shaft for the propeller drive housing which is driven and electrically insulated from the flywheel.

U.S. Pat. No. 5,755,605, which issued to Äsberg on May 26, 1998, describes a propeller drive unit. Installation in a boat has two propeller drive units which extend out through individual openings in the bottom of a V-bottomed boat, so that the legs are inclined relative to each other. The leg of one drive unit can be set to turn the boat in one direction at the same time as the leg of the other drive unit can be set to turn the boat in the opposite direction, so that the horizontal counteracting forces acting on the legs cancel each other, while the vertical forces are added to each other to trim the running position of the boat in the water.

U.S. Pat. No. 6,623,320, which issued to Hedlund on Sep. 23, 2003, describes a drive means in a boat. A boat propeller drive with an underwater housing which is connected in a fixed manner to a boat hull and has tractor propellers arranged on that side of the housing facing ahead is described. Arranged in that end portion of the underwater housing facing astern is an exhaust discharge outlet for discharging exhaust gases from an internal combustion engine connected to the propeller drive.

U.S. Pat. No. 6,705,907, which issued to Hedlund on Mar. 16, 2004, describes a drive means in a boat. A boat propeller drive has an underwater housing which is connected in a fixed manner to a boat hull and has tractor propellers arranged on that side of the housing facing ahead. In the rear edge of the underwater housing, a rudder blade is mounted for pivoting about a vertical rudder axis.

U.S. Pat. No. 6,783,410, which issued to Florander et al. on Aug. 31, 2004, describes a drive means in a boat which has an underwater housing which is solidly joined to a boat hull and has pulling propellers on the forward facing side of the housing. At the aft edge of the underwater housing, a rudder is mounted, comprising a first rudder blade mounted in the underwater housing and a second rudder blade mounted on the aft edge of the first rudder blade.

U.S. Pat. No. 6,582,259, which issued to Mansson et al. on Jun. 24, 2003, describes a boat propeller transmission. The transmission has a horizontal input shaft, a bevel gear set, a vertical intermediate shaft, an additional bevel gear set, and at least one horizontal propeller shaft. Between the bevel gear sets, a two speed planetary gear set is engaged, to provide two gear speeds in the same direction between the input shaft and the propeller shaft. A control unit controls the shifting between the low and high gear speed. A sensor senses the position of a gear selector. When the gear selector is in the reverse position, the control unit locks the planetary gear set in the high speed position, regardless of the engine speed.

U.S. Pat. No. 6,439,937, which issued to Mansson et al. on Aug. 27, 2002, describes a boat propeller transmission. Between two bevel gear sets, a two speed planetary gear set is coupled, to provide two gear speeds in the same direction between the input shaft and the propeller shaft. The planetary gear set has a sun gear which can be locked against the housing of the planetary gear set with the aid of a one way clutch.

International Patent Application WO 03/093105, which was filed by Mansson on Apr. 29, 2003, describes a boat hull with an outboard drive. The drive unit comprises an underwater housing mounted on the outside of the hull bottom and a gear housing mounted on the inside of the hull bottom and joined to the underwater housing. Between the underwater housing and the gear housing there is fixed a mounting plate, which, together with a screw down plate, with elastic ring inserts, fixes the drive unit to a flange which is made on the inside of a well surrounding an opening in the hull bottom.

International Patent Application WO 03/093106, which was filed by Arvidsson et al. on Apr. 29, 2003, describes an outboard drive for boats. It comprises an underwater housing, in which two propeller shafts are mounted and are driven via a first bevel gearing enclosed in the underwater housing, and a second bevel gearing enclosed in a gear housing. With the aid of a mounting element joined to the underwater housing in the gear housing, the drive unit can be mounted in an opening in a bottom of a boat hull, with the underwater housing on the outside and the gear housing on the inside of the hull. The mounting element forms a housing which defines, firstly, an oil reservoir for the oil of the drive unit and, secondly, a surrounding chamber through which engine cooling water flows and which is used for cooling the oil in the reservoir.

U.S. Pat. No. 5,403,216, which issued to Salmi et al. on Apr. 4, 1995, describes a ship propulsion arrangement. A main propulsion arrangement for a high power ship or the like comprises an underwater drive unit connected to and turnable by a substantially vertical tubular shaft journaled in the ship. The drive unit and the tubular shaft define a hollow casing enclosing an electrical propulsion motor connected to a propeller shaft which is connected to a driving propeller external to the casing. The casing is, at its inside, supported by several mainly vertical web plates, which are arranged to act, in combination, as elements structurally stiffening and supporting the casing, as elements securing the propulsion motor in place relative to the casing, as elements transmitting to the casing reaction forces to the torque developed by the propulsion motor, and as wall elements of ducts for incoming and outgoing gaseous coolant for the propulsion motor.

U.S. Pat. No. 4,178,873, which issued to Bankstahl on Dec. 18, 1979, discloses an exhaust coupling assembly for a marine sterndrive. The sterndrive includes an inboard engine having an exhaust passageway connected to an outboard drive unit having an exhaust passageway. A transom bracket assembly positioned between the engine and the drive unit permits vertical pivoting of the drive unit for steering and horizontal pivoting of the drive unit for trimming. The improvement includes a first exhaust pipe connected to the inboard engine and a second exhaust pipe connected the drive unit. The first exhaust pipe extends outward through the transom of the boat and has an open end position centered on and adjacent the vertical pivot axis. The second exhaust pipe extends toward and ends in alignment with the end position of the first exhaust pipe to form an interface which includes an opening between the pipe ends.

U.S. Pat. No. 4,526,002, which issued to Bibow on Jul. 2, 1985, discloses an exhaust relief system. The engine of a sterndrive is provided with a vacuum relief valve to relieve any vacuum which may occur in the exhaust manifold, thus preventing water from entering the engine through the exhaust system. The relief valve is connected to allow one-way flow from the intake manifold to the exhaust system, thus providing an essentially closed system.

U.S. Pat. No. 4,601,666, which issued to Wood on Jul. 22, 1986, describes an air exhaust bypass for underwater exhaust systems. The system relates to outboard motors and inboard-outboard motors and more specifically to the underwater exhaust systems built into both of these types of marine propulsion devices. The object of the invention is to provide a method of an apparatus for selectively rerouting the underwater exhaust through a muffled above-water outlet while effectively blocking the underwater exhaust emanations.

U.S. Pat. No. 4,773,215, which issued to Winberg et al. on Sep. 27, 1988, discloses an exhaust control assembly for a marine sterndrive. The propulsion system has an inboard engine with an exhaust, an outboard drive unit operatively coupled to the engine and separated therefrom by a transom having two exhaust passages therethrough, and an exhaust control assembly aft of the engine exhaust and forward of the transom and within the boat. The assembly has an inlet connected to the engine exhaust, and has first and second outlets communicating with the respective exhaust passages extending aft through the transom. A valve in the assembly selectively controls communication of the inlet with the first outlet.

U.S. Pat. No. 4,834,683, which issued to Govan on May 30, 1989, describes an apparatus for reducing exhaust gas pressure in outboard and inboard/outboard motors. The device increases the efficiency of operation of an internal engine used in outboard and inboard/outboard motors. It comprises a generally cylindrical member having inner and outer peripheral shell members defining a cylindrical annular space therebetween, wherein are located a plurality of turbine vanes spanning the annular volume between the inner and outer shell members. Said inner and outer shell members and said plurality of vanes are drivingly connected to the propeller shaft of an outboard motor and are mounted coaxially with the propeller shaft. The device is located in the forward end of the inner propeller hub and rotatably mounted in association with the lower unit of the outboard or inboard/outboard motor so that exhaust gases flowing through the lower unit pass through the annular volume. Upon rotation of the propeller shaft, the plurality of vanes are caused to rotate at the same angular velocity thereof. The vanes are configured in such a way so that the exhaust gases are caused to be moved through the lower unit at an elevated velocity thereby causing a decrease in pressure between the lower unit and the exhaust port of the combustion chambers. Exhaust gases are thereafter expelled from the rear of the propeller unit. The decrease in pressure at the exhaust ports causes the engine operation to be more efficient due to the decrease in work required by the piston or pistons to expel exhaust gases therefrom.

U.S. Pat. No. 4,891,025, which issued to Brandt on Jan. 2, 1990, describes an arrangement in a boat propeller installation. It relates to an arrangement in propeller installations including means for supplying motor exhaust gases to the vicinity of the propeller. The invention is characterized in that a gas outlet is located immediately forwards of the propeller and directs the gas flow towards the sweep of the blade tips of the propeller.

U.S. Pat. No. 4,927,390, which issued to Kudoh et al. on May 22, 1990, describes a gas exhaustion device for an inboard/outboard engine. At least one of the rigid conduits of the exhaust system is provided with a projection to engage and restrain a hose clamp which may be released and inadvertently dropped so as to prevent loss of the hose clamp into an inaccessible area.

U.S. Pat. No. 4,940,434, which issued to Kiesling on Jul. 10, 1990, discloses a marine propulsion unit universal drive assembly with through-bellows exhaust. A pair of generally telescoped bellows surrounds the universal joint and provides an exhaust passage therebetween which communicates between the inboard engine and the sterndrive unit. The inner bellows rotates with the universal joint while the outer bellows is stationary. The bellows are preferably of helical or spiral configuration and the rotating inner bellows forms an exhaust pump. In one embodiment, the bellows are concentrically disposed, while in another embodiment the bellows are eccentrically disposed.

U.S. Pat. No. 5,212,949, which issued to Shiozawa on May 25, 1993, describes an exhaust gas cleaning system for a marine propulsion unit. A plurality of horizontally positioned exhaust ports are located within an engine cylinder head. An exhaust manifold communicates with each of the exhaust ports at a first end and forms a gas collecting pipe at its second end. The second end of the gas collecting pipe is positioned above the exhaust ports.

U.S. Pat. No. 5,352,141, which issued to Shields et al. on Oct. 4, 1994, discloses a marine drive with dual propeller exhaust and lubrication. The drive has a spool positioned at the lower horizontal bore and supporting a dual propeller shaft assembly. An exhaust passage includes a passage in the drive housing communicating with the horizontal bore at the spool and a spool exhaust passage passing exhaust rearwardly through the spool to the propeller through hub exhaust passages, providing through-hub exhaust through dual propellers. An oil passage in the housing communicates with the horizontal bore forwardly of the exhaust passage and lubricates the dual propeller shaft assembly.

U.S. Pat. No. 5,423,701, which issued to Rodskier et al. on Jun. 13, 1995, describes a propeller arrangement for a marine propulsion unit. A double propeller arrangement for a marine propulsion unit, for example of the type which includes a sterndrive, is provided. Each propeller has a hub consisting of an inner sleeve with splines for attachment to a propeller shaft, an outer sleeve with propeller blades, and an elastic bushing between the sleeves. Particular to the propeller arrangement is that the inner sleeve of the respective propeller hubs is provided with an axial passage for the discharge of exhaust gases from an internal combustion engine connected to the propeller drive.

U.S. Pat. No. 5,857,880, which issued to Harada on Jan. 12, 1999, describes a through the hub propulsion unit exhaust system. The system for an outboard motor discharges exhaust gases in front of the propeller for improved acceleration. The discharge of exhaust gases upstream of the propeller produces a cavitation effect about propeller blades when accelerating from low speeds. As a result, the outboard motor accelerates more rapidly. At high speeds, the exhaust gases flow through the propeller hub and discharge behind the propeller. No substantial cavitation effect occurs about the blades, and thus, no significant loss of propulsion efficiency occurs when traveling at high speeds.

U.S. Pat. No. 5,954,554, which issued to Bates on Sep. 21, 1999, describes an outboard drive exhaust system. It increases the reverse thrust produced by the outboard drive. The exhaust system includes a first exhaust passage and a second exhaust passage that stems from the first exhaust passage. A flow control device operates within the exhaust system to control exhaust gas through the second passage depending upon the drive condition of the outboard drive. The flow control device permits exhaust gas flow through the second passage when the outboard drive operates in reverse, while inhibiting exhaust gas flow through the second passage when the outboard drive operates under a forward drive condition. In this manner, the improved exhaust system reduces exhaust gas back pressure and thrust degradation due to exhaust gas entrainment in the propeller when the outboard drive operates in reverse.

U.S. Pat. No. 6,638,124, which issued to Zoubul et al. on Oct. 28, 2003, describes an arrangement in a marine exhaust system. The arrangement includes at least two substantially upstanding exhaust pipe arms that are coupled together in common closed fluid communication with a stern exhaust pipe. A pressure equalizer is fluidly connected between the upstanding exhaust pipe arms. The pressure equalizer is configured to provide sufficient fluid passage from each exhaust pipe arm to another to prevent flow back of sea water to a marine combustion engine associated therewith.

U.S. Pat. No. 5,441,432, which issued to Rodskier et al. on Aug. 15, 1995, describes a boat propeller drive unit. The unit has an anti-cavitation plate above the propeller or propellers and has an exhaust duct extending through the anti-cavitation plate. The exhaust duct has its outer port located on the underside of the anti-cavitation plate level with and just above the sweep of the blade tips of the aft propeller.

The patents described above are hereby expressly incorporated by reference in the description of the present invention.

As described above, those skilled in the art of marine propulsion systems are well aware of marine propulsion drives that include a vertical driveshaft which extends through a submerged, generally horizontal, surface of a boat. These types of devices include a housing structure that is suspended below the submerged bottom surface of the marine vessel. The housing is rotatable about a generally vertical axis. Devices of this type which use an internal combustion engine to provide motive power to propellers attached to the housing typically mount the propellers in a tractor arrangement, wherein the propellers pull the housing through the water. In these types of systems, engine exhaust is typically ported through openings in the structure near the rear portion of the housing. This allows the exhaust to flow out of the marine drive structure without affecting the operation of the propellers, as a result of ventilation, because the propellers are located at a position which is forward from the exhaust port. Those skilled in the art of marine propulsion systems are also familiar with various types of outboard motors and sterndrive devices which conduct the flow of exhaust gases through the central portion of the propellers mounted on the marine propulsion device. This allows the exhaust gas to exit from the marine propulsion device, through the hub of the propeller, without adversely affecting the operation of the marine propulsion device.

It would be significantly beneficial if a marine propulsion device which has its driveshaft extending vertically through a generally horizontal submerged bottom surface of a marine vessel could be provided with an exhaust system that allows the exhaust gas to pass through the structure of the marine drive and through the propellers. It would be further beneficial if this type of system could be provided in conjunction with a marine drive that mounts its propeller or propellers behind the housing to provide a thrust in a direction toward the housing. This arrangement would allow a push-type marine propulsion system (as opposed to a tractor-type system) to incorporate the strategy of having a vertical driveshaft extending upwardly through the generally horizontal submerged bottom surface of a boat and also causing the exhaust gas from the internal combustion engine to be efficiently entrained in the swirling water behind the propeller or propellers without causing excessive ventilation of the propeller blades. It should be understood that the term "housing", as used herein, is intended to refer to the structure which is supported at least partially below the marine vessel and is configured to support the generally vertical drive shaft, generally horizontal propeller shaft, and associated gears and bearings of a marine propulsion system.

SUMMARY OF THE INVENTION

A marine propulsion system made in accordance with a preferred embodiment of the present invention comprises a driveshaft and housing configured to support the driveshaft for rotation about a generally vertical axis. The housing is rotatably attached to a submerged bottom surface of a marine vessel with the driveshaft extending through the submerged bottom surface. A preferred embodiment of the present invention further comprises a propeller shaft, a first propeller attached to the propeller shaft for rotation about a generally horizontal axis, and an exhaust passageway extending from a first location above the submerged bottom surface to a second location within a hub of the first propeller. The housing is configured to support the propeller shaft for rotation about a generally horizontal axis. The driveshaft is disposed in torque transmitting relation with the propeller shaft. The first propeller is configured to provide a thrust toward the housing when the marine vessel is being propelled in a forward direction.

In a particularly preferred embodiment of the present invention, the exhaust gas passageway comprises an exhaust conduit which is disposed at the first location above the submerged bottom surface, a cavity within the housing, an exhaust passage connected in fluid communication between the exhaust conduit and the cavity, and an exhaust channel connected in fluid communication with the cavity and disposed within the housing to direct exhaust gases toward the second location within the hub of the first propeller. A preferred embodiment of the present invention can further comprise a first exhaust duct formed within a hub of the first propeller and disposed in fluid communication with the exhaust channel to direct the exhaust gas away from the marine propulsion system.

The marine propulsion system can comprise a second propeller attached to the propeller shaft for rotation about the generally horizontal axis and configured to provide a thrust toward the housing when the marine vessel is being propelled in a forward direction and a second exhaust duct formed within a hub of the second propeller and disposed in fluid communication with the exhaust channel to direct the exhaust gas away from the marine propulsion system.

The exhaust passage, in a preferred embodiment of the present invention, can comprise a stationary plate and a rotatable plate. The stationary plate is attached to the exhaust conduit and the rotatable plate is attached to the housing for rotation with the housing relative to the stationary plate. The rotatable plate has a first hole extending therethrough. The stationary plate has a second hole extending therethrough. The first and second holes are shaped to remain in at least partially overlapping relation with each other when the housing rotates relative to the marine vessel.

In a preferred embodiment of the present invention, it can further comprise a seal attached to the stationary plate and surrounding the second hole. It can also comprise a non-metallic plate attached to the rotatable plate and disposed between the stationary and rotatable plates. The seal can be metallic. In a preferred embodiment of the present invention, a bearing support structure is disposed within the housing and shaped to define the exhaust channel. The exhaust channel is shaped to direct the exhaust gas radially inward toward the generally horizontal axis of the propeller shaft and then axially in a direction generally parallel to the generally horizontal axis and rearwardly toward the first propeller.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
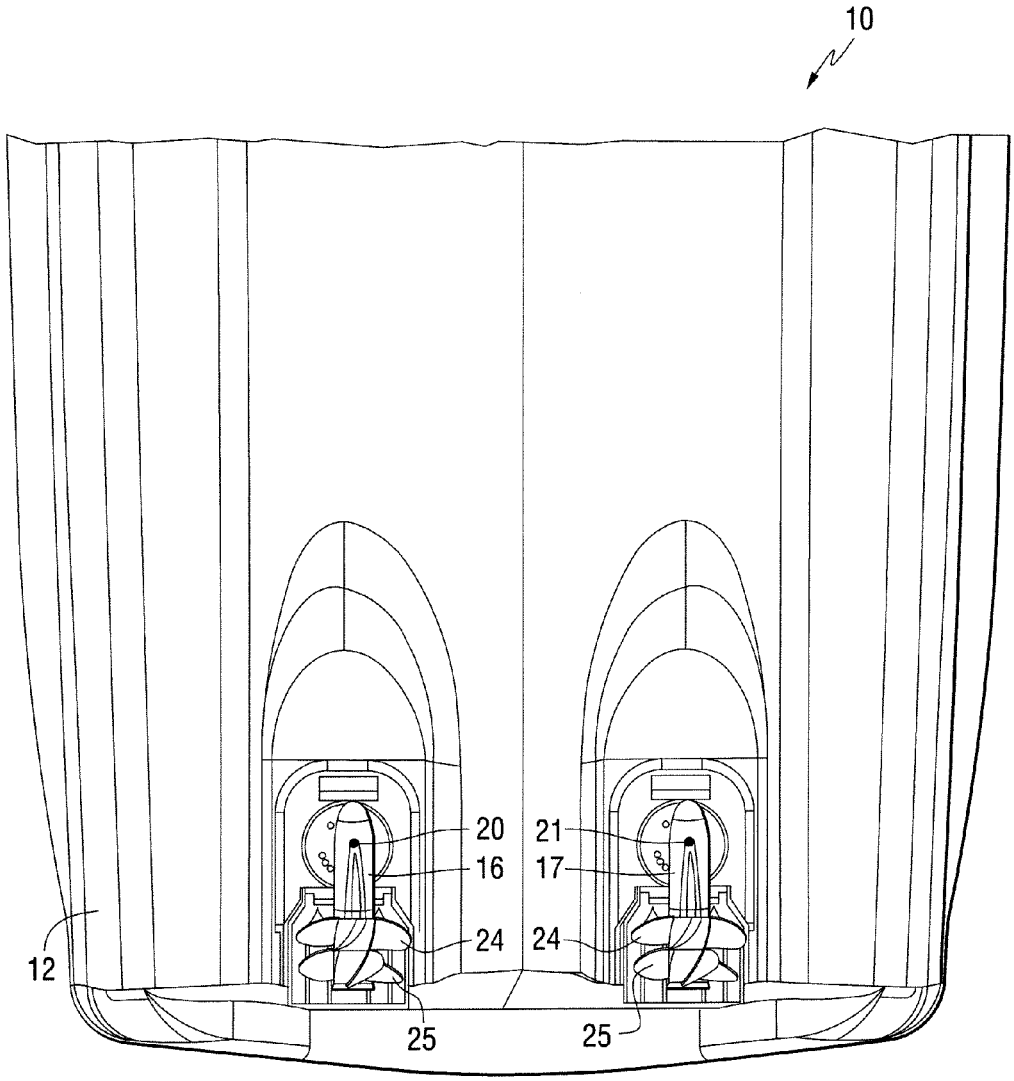
FIG. 1 is a bottom view of a marine vessel having marine propulsion devices with which the present invention is applicable.

Throughout the description of the preferred embodiment of the present invention, like components will be identified by like reference numerals.

Figure 2:
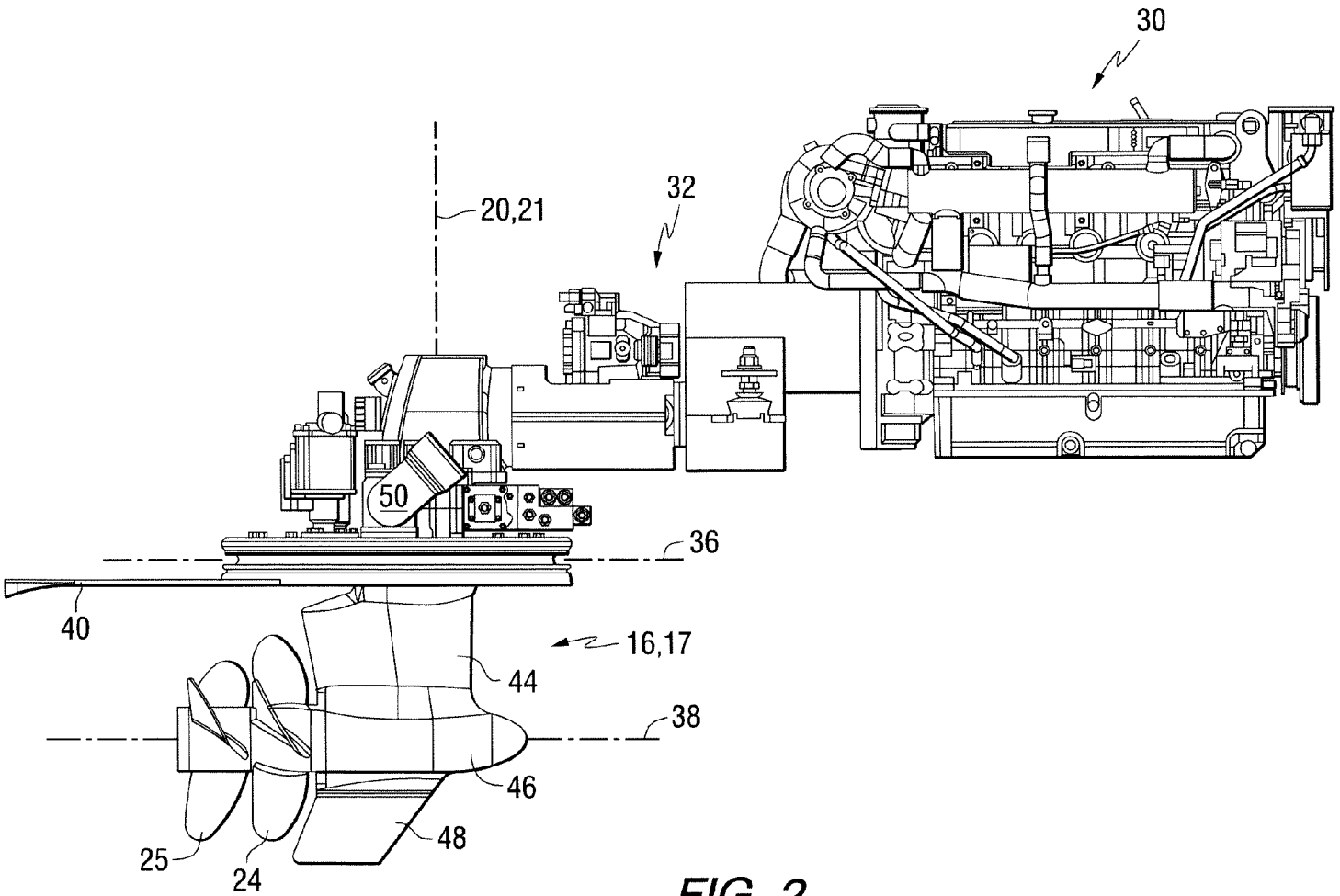
FIG. 2 is a side view of a marine propulsion system such as that illustrated in FIG. 1.

FIGS. 1 and 2 show two views of a marine propulsion system that is particularly suitable for use in combination with the present invention. FIG. 1 is a bottom view of a boat 10 having a hull 12 through which driveshafts extend to provide torque to first and second marine propulsion devices, 16 and 17, which are rotatable about steering axes, 20 and 21, respectively. Each of the marine propulsion devices is provided with a first propeller 24 and a second propeller 25. However, it should be understood that alternative embodiments of the present invention could be adapted to use a single propeller for each of the two marine propulsion devices, 16 and 17.

FIG. 2 is a side view of the marine propulsion system illustrated in FIG. 1. An engine 30 is supported within the bilge, or hull portion, of the marine vessel 10 described above in conjunction with FIG. 1. As can be seen in FIG. 2, the engine 30 is disposed to support a crankshaft (not shown in FIG. 2) for rotation about a generally horizontal axis. The crankshaft is connected in torque transmitting relation with a transmission system 32 which is also located above the submerged generally horizontal surface of the hull of the marine vessel which is represented by dashed line 36 in FIG. 2. The components illustrated in FIG. 2 above dashed line 36 are stationary. As is well understood by those skilled in the art, the engine 30 has a crankshaft which is rotatable about a generally horizontal axis and the marine propulsion system has a driveshaft (not shown in FIG. 2) which is rotatable about the steering axes represented by dashed line 20, 21 in FIG. 2. Each of the marine propulsion systems, 16 and 17, are configured to support a propeller shaft for rotation about a generally horizontal axis 38. The marine propulsion systems, identified by reference numerals 16 and 17 in FIG. 2, is rotatable about the steering axis. A trim plate 40 is also illustrated in FIG. 2.

With continued reference to FIGS. 1 and 2, the housing 44 has a portion 46 which is particularly configured to support a propeller shaft to which first and second propellers, 24 and 25, are attached for rotation about the generally horizontal axis 38. A skeg 48 extends downwardly from the housing 44 as shown in FIG. 2.

With continued reference to FIGS. 1 and 2, it should be noted that the propulsion system illustrated is of the pusher-type propulsion drive. In other words, the propellers, 24 and 25, are disposed behind the housing 44 and, when the marine vessel 10 is operated in a forward direction, the propellers provide a thrust which extends in a direction toward the housing 44. This thrust pushes the housing 44 through the water and, as a result, provides forward propulsion for the marine vessel 10. As is well understood by those skilled in the art, the propellers, 24 and 25, can be operated in a reverse rotational direction to create reverse thrusts for the marine propulsion system. However, as is conventionally understood by those skilled in the art of marine propulsion devices, normal forward operation of the marine vessel requires that the propellers, 24 and 25, provide a thrust which pushes against the housing 44 when the marine vessel 10 is operated in a forward direction. This type of marine propulsion system, illustrated in FIGS. 1 and 2, operates in a manner that is directly opposite to the type of marine propulsion system described in U.S. Pat. No. 6,623,320 which is referred to by those skilled in the art as a tractor-type marine propulsion system. In a tractor-type system, the thrust provided by the rotating propellers pulls the housing through the water. This force is transferred to the marine vessel and provides forward movement. U.S. Pat. No. 6,783,410, described above, and U.S. Pat. No. 6,705,907, both show tractor-type marine propulsion devices. The marine propulsion device described in the International Patent Application WO 03/093105 and in the International Patent Application WO 03/093106 illustrate tractor-type marine propulsion devices configured to have a driveshaft which extends generally vertically through a submerged bottom surface of a marine vessel.

It is important to note the difference between tractor-type marine propulsion devices and pusher-type marine propulsion devices, particularly as they relate to the management of exhaust gases. In tractor-type marine propulsion devices, such as those described immediately above, the propeller is in front of the housing structure and exhaust gases can be released from virtually any portion of the submerged housing without adversely affecting the propulsion efficiency of the propellers by causing ventilation of the propeller. When the exhaust gas is released behind the propellers in a tractor-type marine propulsion system, it does not generally create ventilation of the propellers. However, in a pusher-type propulsion device, where the propellers are located at a rearmost location relative to the housing, such as that illustrated in FIGS. 1 and 2, exhaust gases are much more likely to flow into and be entrained within the annular path of the blades of the propellers if they are emitted in front of, above or alongside of the propellers. This could create severe ventilation problems in which the propeller blades are rotating through a fluid which is significantly less dense than water. Although under certain acceleration conditions, a controlled amount of ventilation can be helpful, this condition is deleterious when it is desirable to achieve maximum thrust from the propellers. In other words, when the marine vessel is operating under a wide open throttle (WOT) condition, it is not generally advantageous to have gaseous bubbles (e.g. exhaust gas) within the path of the propeller blades. Therefore, it should be understood that a system such as that which is illustrated in FIGS. 1 and 2 can experience severely deleterious conditions when configured to release exhaust gas from the housing in the manner which is typical in tractor-type applications. The present invention provides an exhaust system for a marine propulsion device that directs a flow of exhaust gas from the engine 30 to a location within the hubs of the propellers, 24 and 25, so that exhaust gas can be released below the water surface under the marine vessel without adversely affecting the efficiency of operation of the marine propulsion devices, 16 and 17.

Figure 3:
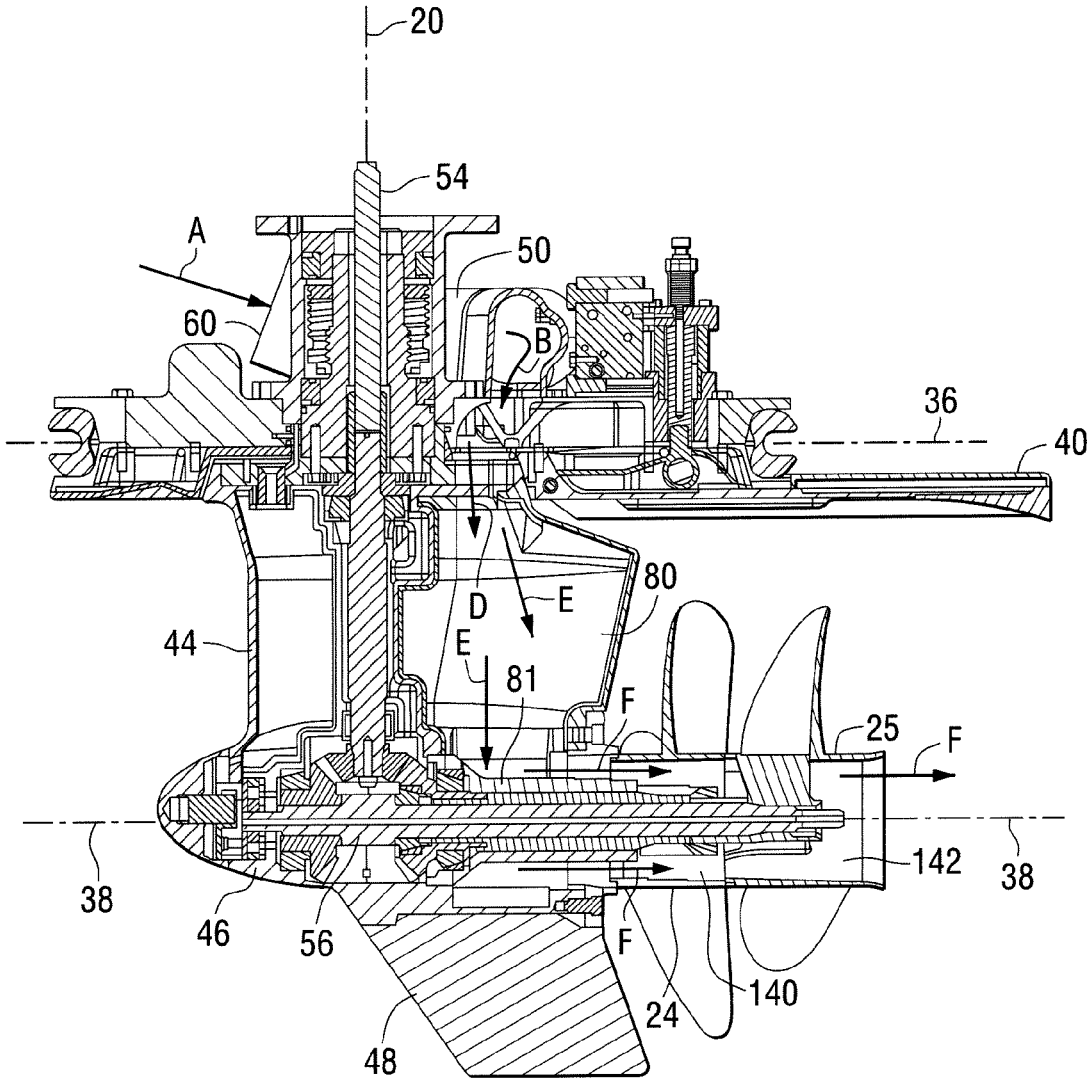
FIG. 3 is a section view taken through a marine propulsion system incorporating the concepts of the present invention.

FIG. 3 is a section view taken through the housing 44 of a marine propulsion system made in accordance with a preferred embodiment of the present invention. The driveshaft 54 is supported for rotation about the generally vertical axis 20 and is connected in torque transmitting relation with a propeller shaft 56 which is supported by the propeller shaft portion 46 of the housing 44. Since two counter rotating propellers, 24 and 25, are used in the embodiment shown in FIGS. 1-3, the propeller shaft 56 is a compound shaft which comprises two counter rotating shafts, one within the other, which both rotate about the propeller shaft axis or generally horizontal axis 38. A provision of counter rotating shafts is well known to those skilled in the art of marine propulsion and will not be described in greater detail herein. However, it should be understood that when reference is made to a propeller shaft, that terminology shall be taken to include either a single propeller shaft for use with a single propeller or, as illustrated in FIGS. 1-3, a compound propeller shaft which comprises counter rotating shafts supported for rotation about a common axis.

Figure 4:
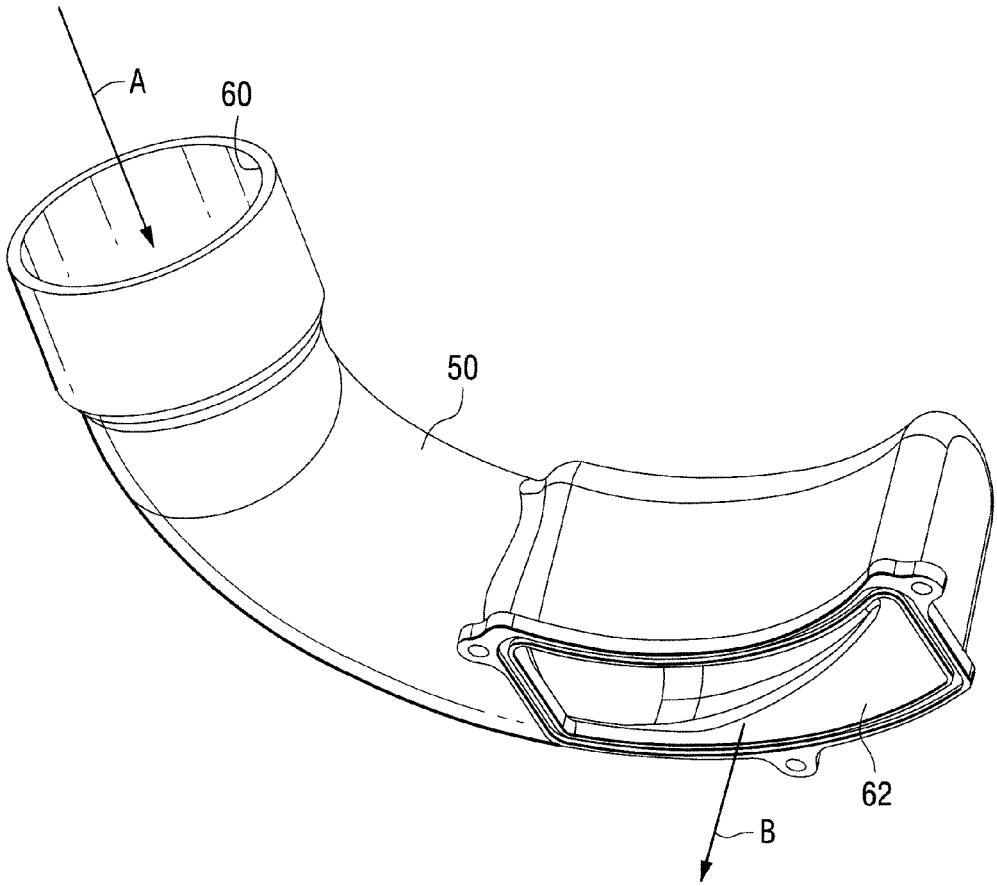
FIG. 4 is an isometric view of a stationary exhaust conduit used in conjunction with the present invention.

With continued reference to FIG. 3, arrow A represents the initial entry of exhaust gas into the inlet 60 of the exhaust conduit 50 which is also shown in FIG. 2. Arrow B represents the passage of the exhaust gas from the outlet of the exhaust gas conduit 50. With reference to FIGS. 3 and 4, arrows A and B illustrate the passage of the exhaust gas from the inlet 60 of the exhaust conduit 50 and out of its outlet 62. The exhaust conduit 50 is generally stationary and mounted on the stationary portion of the marine propulsion device located above the submerged bottom surface of the marine vessel which is represented by dashed line 36.

Figure 5:
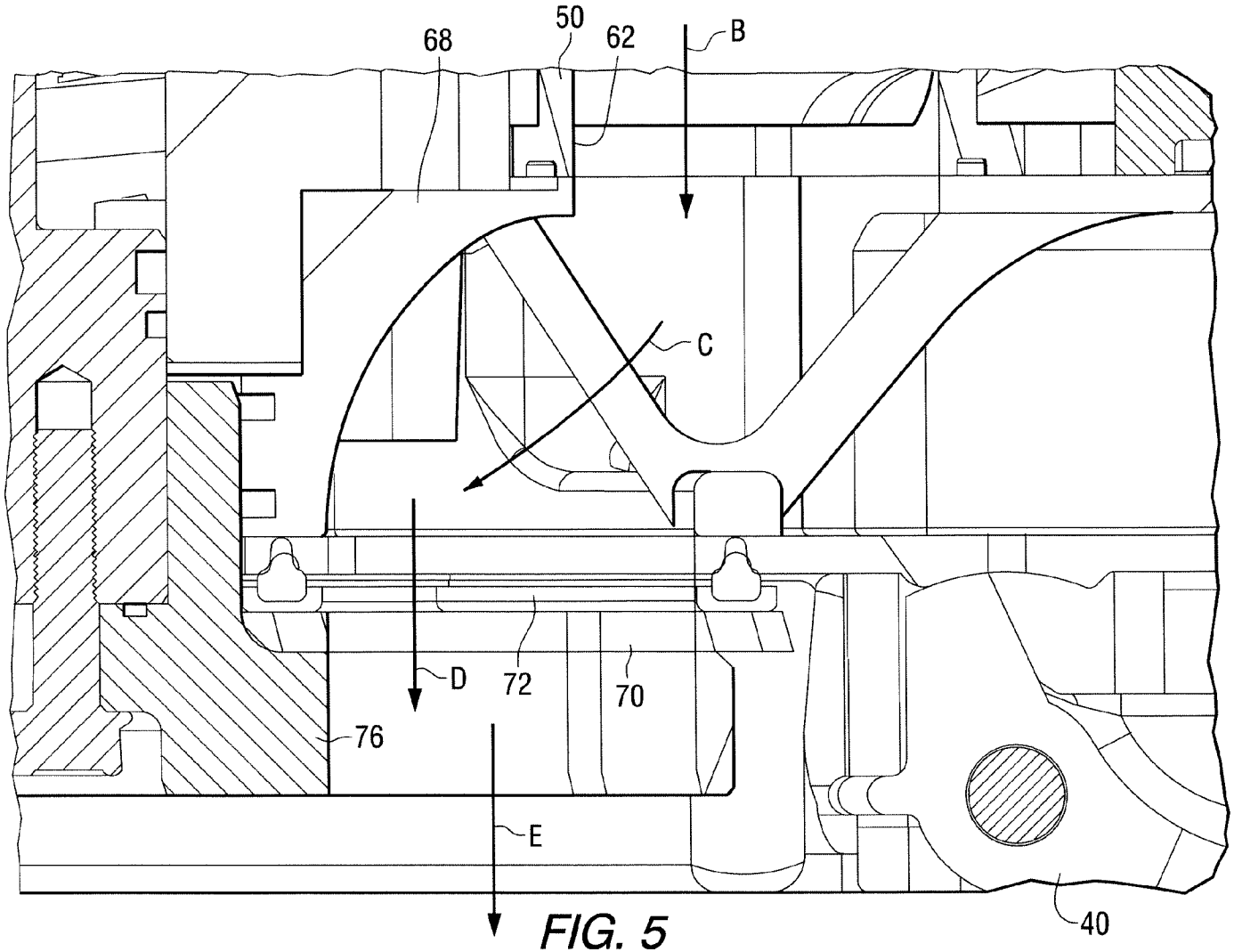
FIG. 5 is an expanded illustration of a portion of FIG. 3.

FIG. 5 is an expanded view of a portion of FIG. 3. The exhaust gas, represented by arrow B, passes through the outlet 62 of the exhaust conduit 50 and through a stationary midsection portion 68 of the marine propulsion device. The exhaust gas flowing through the midsection portion 68 is identified by arrow C in FIG. 5.

With continued reference to FIGS. 3 and 5, the exhaust gas is identified by arrow D as it flows from the stationary portion of the marine propulsion system and into the rotatable portion. To facilitate this interface, a wear plate 70 is attached to the rotatable portion and a seal plate 72 is attached between the wear plate 70 and the stationary midsection structure 68. The wear plate 70 can be made of a polymer material. A rotatable portion 76 is rigidly attached for rotation with the housing 44. Arrow E in FIGS. 3 and 5 illustrate the passage of exhaust gas into the cavity 80 formed within the housing 44.

Figure 6:
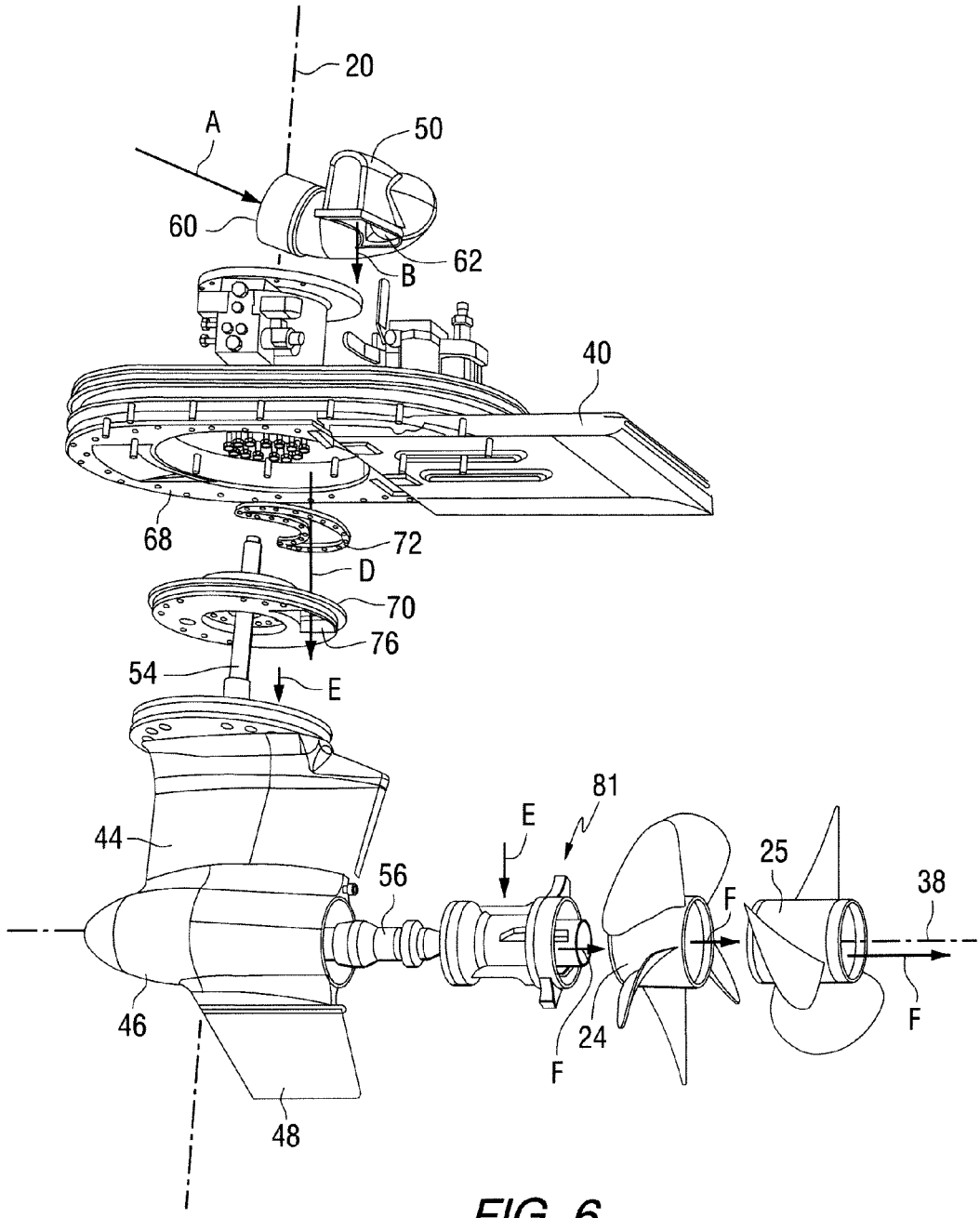
FIG. 6 is an exploded view of a propulsion system made in conjunction with the present invention.

FIG. 6 is an exploded view showing the marine propulsion device of the present invention. The stationary midsection 68 is shown with the trim tab 40 in place to provide reference to the figures described above. The exhaust conduit 50 is shown directing exhaust gas passing through its inlet, as represented by arrow A, toward a downward direction flowing out of its outlet 62, represented by arrow B. The exhaust gas is passed through the midsection 68 (as identified by arrow C in FIG. 5) and continues to flow in a downward direction as represented by arrow D in FIG. 6. In doing so, the exhaust gas passes through the seal plate 72, which is attached to the stationary midsection 68, and through the rotatable portion 76 of the exhaust passage which is attached for rotation with the housing 44. The exhaust continues downwardly, as represented by arrow E in FIG. 6, into the cavity formed within the housing 44.

With continued reference to FIGS. 3 and 6, the exhaust gas is turned, in a rearwardly horizontal direction, when it reaches the bottom portion of the cavity 80 within the housing 44. This turning function is performed by a bearing carrier 81 in a in a preferred embodiment of the present invention. The bearing carrier 81 serves the function of providing an exhaust channel that connects the cavity 80 in fluid communication with the second location within the hub of the first propeller 24. In other words, it turns the exhaust flow from a downward direction E within the cavity 80 of the housing 44 to a rearwardly directed horizontal direction through the propellers. This is represented by the change in direction from arrows E in FIG. 6 to arrows F. Although FIG. 6 is an exploded view of the marine propulsion device, it should be understood that the bearing carrier 81 is located directly below a bottom passage out of the cavity 80 within the housing 44. This is illustrated in FIG. 3.

Figure 7:
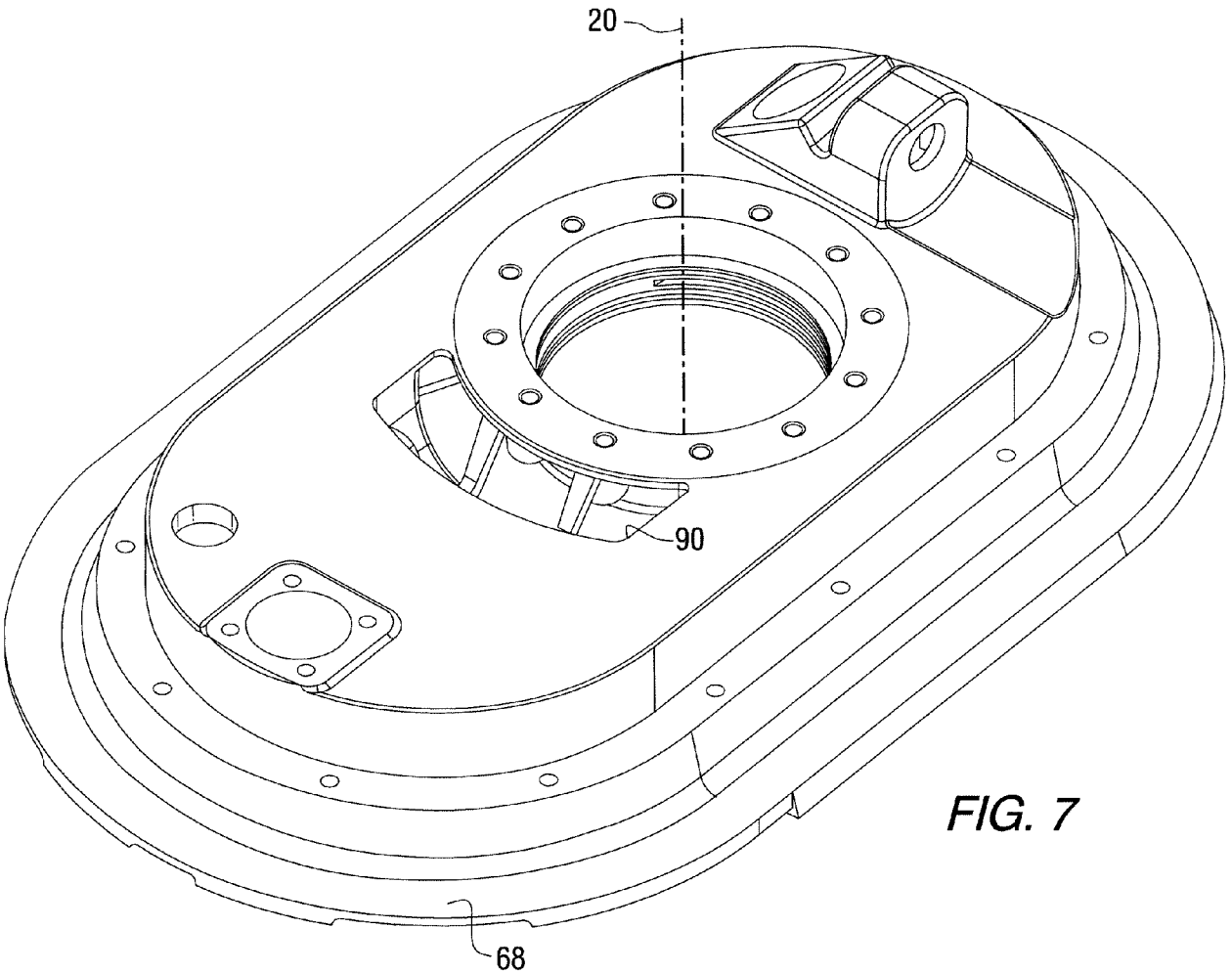
FIG. 7 is a top isometric view of a stationary midsection portion of a preferred embodiment of the present invention.
Figure 8:
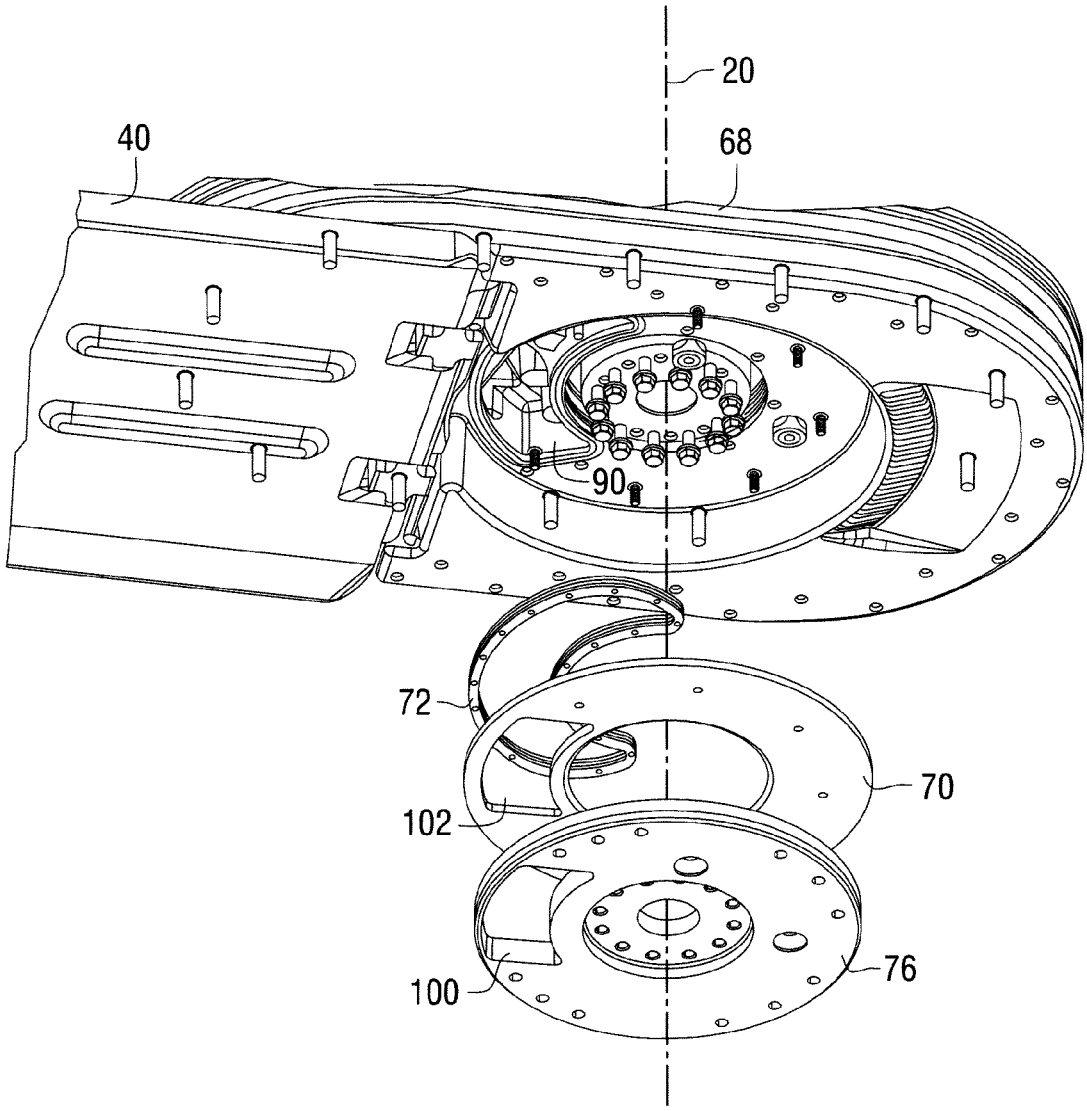
FIG. 8 is an exploded isometric view of the lower portion of the midsection illustrated in FIG. 7.

FIG. 7 is an isometric view of the stationary midsection 68. In FIG. 7, the top surface of the stationary midsection 68 is illustrated. For reference, the generally vertical axis 20 of the driveshaft is also illustrated. A stationary exhaust passage 90 is formed through the structure of the midsection 68. FIG. 8 is also an isometric view of the midsection 68, but with several additional components shown in relation to the bottom surface of the midsection. The seal plate 72 is disposed around the periphery of the exhaust passage 90 which extends through the structure of the midsection 68. The wear plate 70 is shown above the kingpin flange, or rotatable portion 76 of the exhaust system. Openings, 100 and 102, are formed through the rotatable portion 76, or kingpin flange, and through the wear plate 70. These rotatable exhaust openings, 100 and 102, rotate with the housing 44. The stationary opening 90 and its seal plate 72 are attached to the midsection 68 and do not rotate. The exhaust gas passes through both the stationary exhaust openings, provided by the exhaust conduit 50 and the exhaust opening 90 and also through the rotatable exhaust openings, 100 and 102. The trim tab 40 and generally vertical axis 20 of the driveshaft are shown in FIG. 8 to provide perspective in conjunction with the drawings described above.

Figure 9:
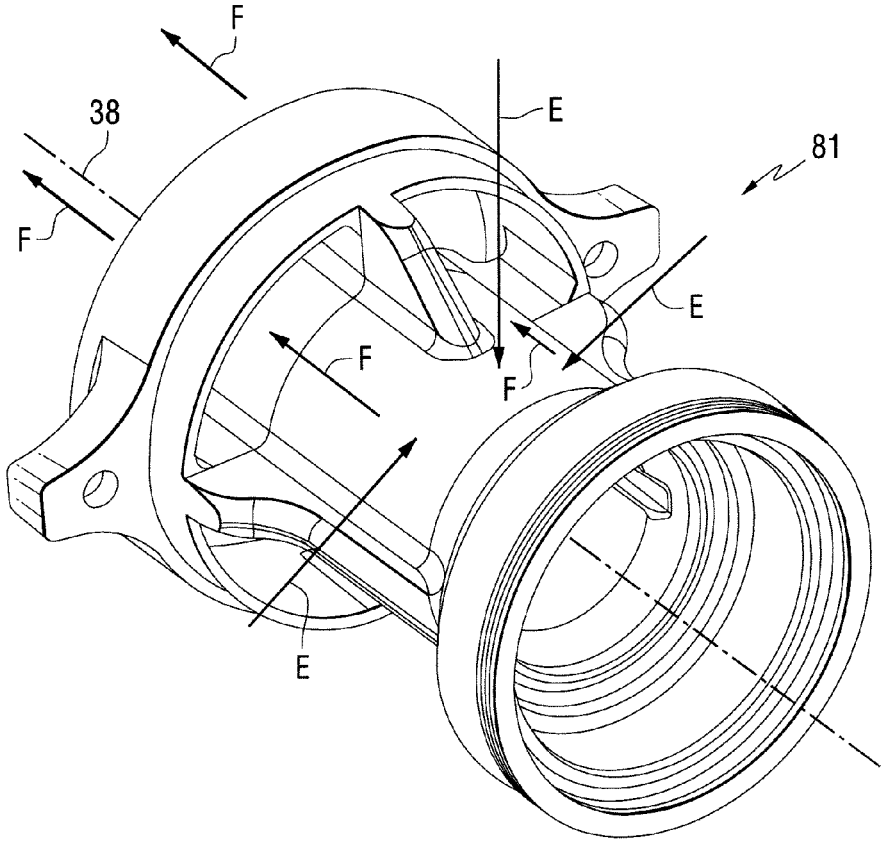
FIG. 9 shows a bearing carrier used in a preferred embodiment of the present invention.

FIG. 9 is an isometric view of the bearing carrier 81. Arrows E represent the flow of exhaust gas from the cavity 80, as illustrated above in conjunction with FIGS. 3 and 6. Arrows F represent the flow of exhaust gas after the bearing carrier 81 acts as an exhaust channel to turn the exhaust gas from a first direction which is generally radially inward toward the propeller axis 38 to a generally horizontal flow F which is generally parallel to the propeller shaft axis 38. This function of the bearing carrier 81 is illustrated in FIGS. 3, 6 and 9.

Figure 10:
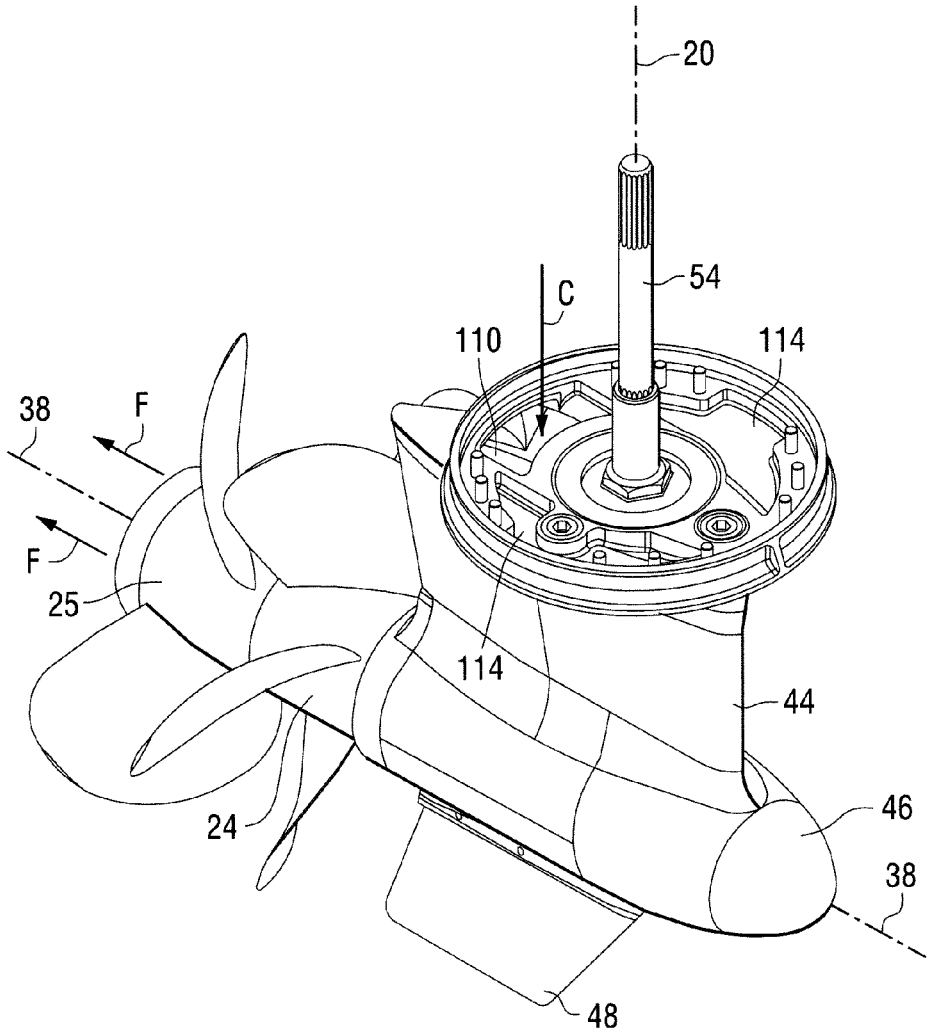
FIG. 10 is an isometric view of a housing with a driveshaft and propellers.

FIG. 10 is an isometric view of the housing 44, its propeller shaft supporting portion 46, its skeg 48, and two propellers, 24 and 25. With reference to FIGS. 8 and 10, FIG. 10 does not show the kingpin flange 76, or rotatable housing mounting flange. In addition, it does not show the wear plate 70. These two components are intended to be rigidly attached to the housing 44 for rotation with it about the steering axis 20. For purposes of reference, arrow C shows the exhaust gas flowing downwardly as it is directed by the midsection 68 (not shown in FIG. 10). Opening 110 serves as a rotatable exhaust opening to allow this flow of exhaust gas downwardly into the cavity within the housing 44. The openings identified by reference numeral 114 in FIG. 10 are intended to lighten the overall weight of the marine propulsion system and are not intended to perform any other particular function. Arrows F illustrate the flow of exhaust gas through and away from the propellers, 24 and 25.

Figure 11:
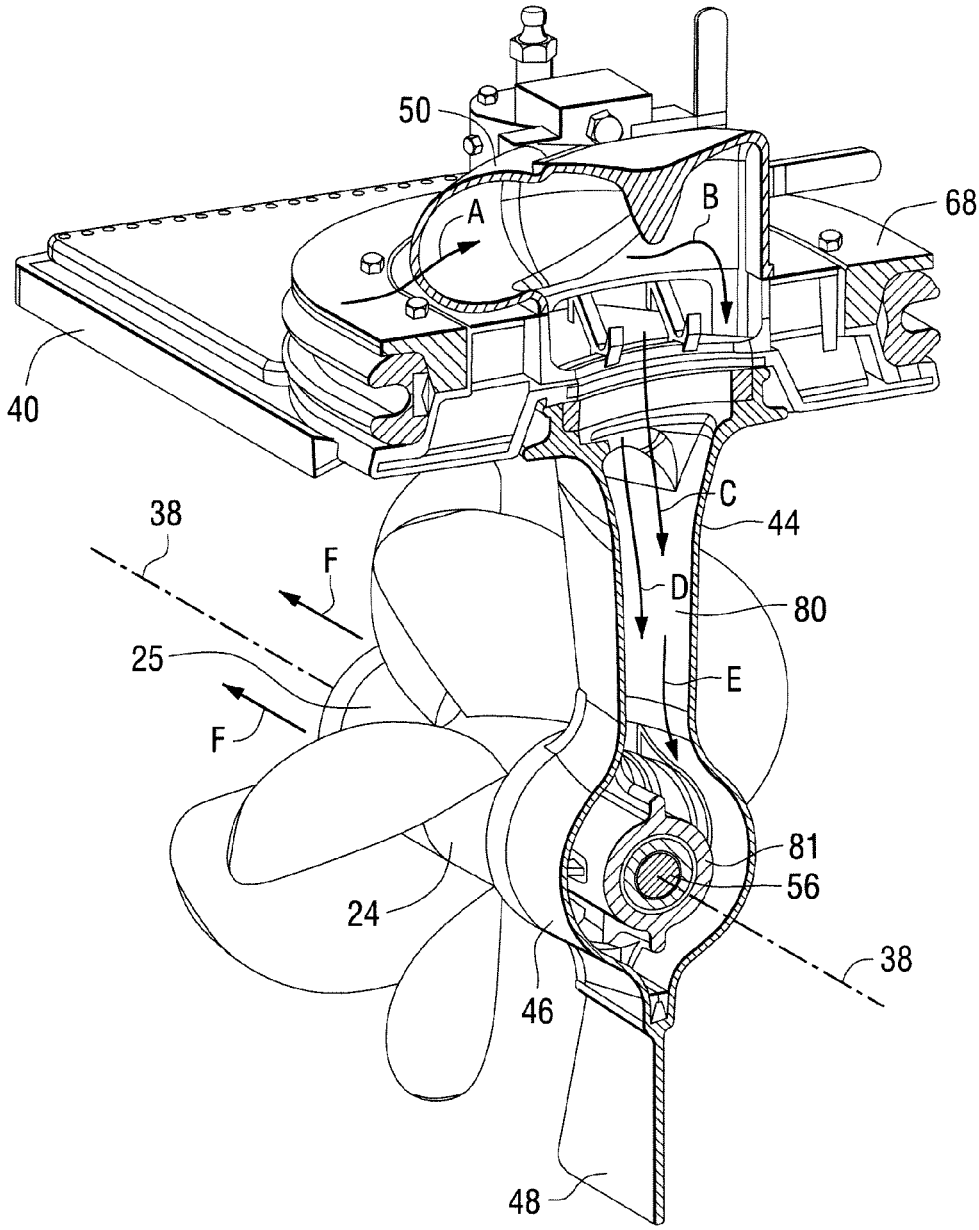
FIG. 11 is a section view taken through a marine propulsion device made in accordance with a preferred embodiment of the present invention.

FIG. 11 is a section view of the marine propulsion system of a preferred embodiment of the present invention taken along a vertical plane. As shown, the exhaust gas passes through the exhaust conduit 50, as represented by arrows A and B, downwardly through the interface between the stationary midsection 68 and the rotatable housing 44, as represented by arrow C, into and through the cavity 80 within the housing 44, as represented by arrows D and E, and out through the hubs of the propellers, 24 and 25, as represented by arrows F. The bearing carrier 81 is shown supported within the propeller shaft supporting portion 46 of the housing 44 along with the propeller shaft 56. For purposes of perspective, the trim tab 40, generally horizontal propeller axis 38, and skeg 48 are also illustrated in FIG. 11.

Figures 12A, 12B, 12C:
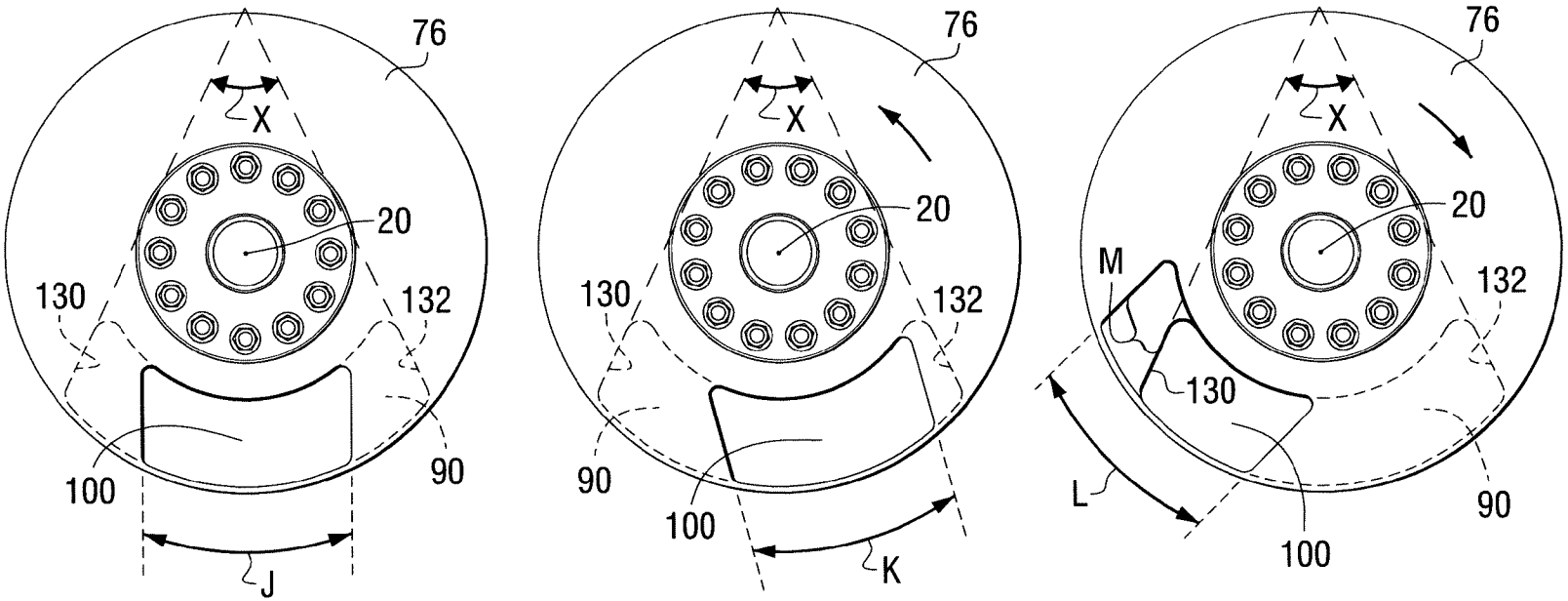
FIGS. 12A, 12B and 12C are schematic representations showing the positions of overlap, under various steering conditions, of the stationary and rotatable portions of the present invention.

FIGS. 12A, 12B and 12C are bottom views of the rotatable portion of the exhaust system, or kingpin flange 76, in conjunction with the stationary exhaust opening 90 formed within the midsection 68 under various different steering situations. With reference to FIGS. 6, 8, 12A, 12B and 12C, rotation of the housing 44 changes the relative positions of the stationary exhaust opening 90 and the rotatable exhaust openings, such as those identified by reference numerals 100 and 102 in FIG. 8. As a result, the flow of exhaust gas is limited to the area of overlap between the stationary and rotatable exhaust openings. FIGS. 12A, 12B and 12C illustrate these relationships for various rotatable positions of the kingpin flange 76, or rotatable housing mounting flange. The stationary opening 90 is illustrated in FIGS. 12A, 12B and 12C as extending between edges 130 and 132 to define an angle identified by arrow X. This opening is stationary and does not change in position regardless of the rotation of the housing 44. It should also be understood that the stationary opening 90 is larger, in arcuate length, than the rotatable openings, 100 and 102.

Arrow J in FIG. 12A describes the arcuate dimension between the positions of the edges of the rotatable openings, 100 and 102, which are formed in the rotatable exhaust structure, or kingpin flange 76. The position represented by arrow J shows the relationship between the stationary and rotatable openings when the marine propulsion device is aligned with a straight ahead heading and the marine vessel is not turning toward either port or starboard.

Arrow K in FIG. 12B identifies the degree of overlap between the stationary and rotatable exhaust openings when the housing 44 is turned at a 15 degree angle from a straight ahead heading. It illustrates the positions of the edges of the rotatable openings, 100 and 102, when the housing 44 is turned at a 15 degree angle from a straight ahead heading.

Arrow L in FIG. 12C shows the position of the rotatable exhaust openings, 100 and 102, when the marine propulsion device is turned at a 45 degree angle relative to a straight ahead heading. When the marine propulsion device is turned, as represented by arrow L in FIG. 12C, it can be seen that the area of the overlap between the stationary and rotatable positions is less than the total area of the rotatable exhaust opening 100. This reduction in available cross-sectional area is identified by reference letter M in FIG. 12C and results from edge of the rotatable opening moving in a clockwise direction past the associated edge of the stationary opening. However, since it is not expected that the exhaust flow will be at a maximum magnitude during a 45 degree turn, this temporary reduction in flow area does not adversely affect the overall operation of the marine vessel.

With continued reference to FIGS. 12A, 12B and 12C, it has been described above that a 15 degree turn, identified by arrow K, results in no reduction of available area of the exhaust passage. The available area under this condition of a 15 degree turn is equivalent to the available area during straight ahead movement, as identified by arrow K. The only reduction in the exhaust area occurs with the more severe 45 degree turn which is identified by arrow L and this condition is unlikely to require the full exhaust area.

With reference to FIGS. 1-11, 12A, 12B and 12C, it can be seen that a marine propulsion system, made in accordance with a preferred embodiment of the present invention, comprises a driveshaft 54, a housing 44 configured to support the driveshaft 54 for rotation about a generally vertical axis, 20 or 21, and is rotatably attached to a submerged bottom surface of a marine vessel 10 with the driveshaft 54 extending through the submerged bottom surface. It further comprises a propeller shaft 56. The housing 44 is configured to support the propeller shaft 56 for rotation about a generally horizontal axis 38. The driveshaft 54 is disposed in torque transmitting relationship with the propeller shaft 56. A first propeller 24 is attached to the propeller shaft 56 for rotation about the generally horizontal axis 38 and is configured to provide a thrust toward the housing 44 when the marine vessel 10 is being propelled in a forward direction. An exhaust gas passageway extends from a first location above the submerged bottom surface to a second location within a hub of the first propeller 24.

In a preferred embodiment of the present invention, the exhaust gas passageway comprises an exhaust conduit 50 which is disposed at the first location above the submerged bottom surface, a cavity 80 within the housing 44, an exhaust passage connected in fluid communication between the exhaust conduit 50 and the cavity 80 and an exhaust channel connected in fluid communication with the cavity 80 and disposed within the housing 44 to direct exhaust gas toward the second location within the hub of the first propeller 24. A first exhaust duct 140 is formed within the hub of the first propeller 24 and disposed in fluid communication with the exhaust channel to direct the exhaust gas away from the marine propulsion system. The present invention can further comprise a second propeller 25 attached to the propeller shaft 56 for rotation about the generally horizontal axis 38 and configured to provide a thrust toward the housing 44 when the marine vessel is being propelled in a forward direction. A second exhaust duct 142 is formed within the hub of the second propeller 25 and disposed in fluid communication with the exhaust channel provided by the bearing carrier 80 to direct the exhaust gas away from the marine propulsion system. The exhaust passage of the preferred embodiment of the present invention can comprise a stationary plate (such as the midsection 68) which is attached to the exhaust conduit 50 and a rotatable plate (such as the kingpin flange 76, or rotatable housing mounting flange) which is attached to the housing 44 for rotation with the housing relative to the stationary plate 68. The rotatable plate has a first hole 100 extending therethrough. The stationary plate 68 has a second hole 90 extending therethrough. The first and second holes, 100 and 90, are shaped to remain in at least partially overlapping relation with each other when the housing 44 rotates relative to the marine vessel 10. This overlapping relationships are illustrated in FIGS. 12A, 12B and 12C and are described above. The marine propulsion system in a preferred embodiment of the present invention can further comprise a seal 72 attached to the stationary plate 68 and disposed between the stationary and rotatable plates, 68 and 76. The seal 72 can be metallic and a wear plate 70 can be made of a polymer material. A bearing support structure 81 is disposed within the housing 44 and shaped to define the exhaust channel of the exhaust gas passageway. The exhaust channel is shaped to direct the exhaust gas radially inward toward the generally horizontal axis 38 and then axially in a direction generally parallel to the generally horizontal axis 38 and rearwardly toward the first propeller 24. Exhaust ducts, 140 and 142, are formed within the hubs of the first and second propellers, 24 and 25, to direct the exhaust gas through the propellers and away from the marine propulsion system.

The exhaust system of the present invention, in a preferred embodiment, is intended for use with a marine propulsion system that comprises a driveshaft that rotates about a generally vertical axis and extends through a lower submerged hull portion of a marine vessel. In addition, the present invention is intended for use with a marine propulsion system of the pusher-type in which the propeller rotates to provide a forward thrust that pushes against the housing and, as a result, provides a forward thrust exerted on a marine vessel. It is not intended for use with a tractor-type marine propulsion device which locates the propellers in front is of the housing when the marine vessel is propelled in a forward direction.

Although the present invention has been described with considerable detail and illustrated to show a preferred embodiment, it should be understood that alternative embodiments are also within its scope.

I claim:

1. A marine propulsion system, comprising:

a driveshaft;

a housing configured to support said driveshaft for rotation about a generally vertical axis, said housing being rotatably attached to a submerged bottom surface of a marine vessel with said driveshaft extending through said submerged bottom surface;

a propeller shaft, said housing being configured to support said propeller shaft for rotation about a generally horizontal axis, said driveshaft being disposed in torque transmitting relation with said propeller shaft;

a first propeller attached to said propeller shaft for rotation about said generally horizontal axis and configured to provide a thrust toward said housing when said marine vessel is being propelled in a forward direction; and an exhaust gas passageway extending from a first location above said submerged bottom surface to a second location within a hub of said first propeller;

wherein said exhaust gas passageway comprises:

an exhaust conduit which is disposed at said first location above said submerged bottom surface;

a cavity within said housing;

an exhaust passage connected in fluid communication between said exhaust conduit and said cavity;

an exhaust channel connected in fluid communication with said cavity and disposed within said housing to direct exhaust gas toward said second location;

wherein said exhaust passage comprises:

a stationary plate attached to said exhaust conduit; and a rotatable plate attached to said housing for rotation with said housing relative to said stationary plate, said rotatable plate having a rotatable first hole extending therethrough, said stationary plate having a stationary second hole extending therethrough, said first and second holes being shaped to remain in at least partially overlapping relation with each other when said housing rotates relative to said marine vessel, said rotatable first hole being smaller than said stationary second hole.

2. The marine propulsion system of claim 1 an exhaust channel connected in fluid communication with said cavity and disposed within said housing to direct exhaust gas toward said second location;

wherein said exhaust passage comprises:

a stationary plate attached to said exhaust conduit;

a rotatable plate attached to said housing for rotation with said housing relative to said stationary plate, said rotatable plate having a first hole extending therethrough, said stationary plate having a second hole extending therethrough, said first and second holes being shaped to remain in at least partially overlapping relation with each other when said housing rotates relative to said marine vessel;

and further comprising:

a seal attached to said stationary plate and surrounding said second hole; and a nonmetallic plate attached to said rotatable plate and disposed between said stationary and rotatable plates;

wherein:

said seal is metallic.

3. The marine propulsion system of claim 1 wherein said stationary second hole comprises an arcuate segment of an annulus around said axis, said arcuate segment having an inner arcuate span and an outer arcuate span, said outer arcuate span being spaced radially outwardly of said inner arcuate span.

4. The marine propulsion system of claim 3 wherein said inner and outer arcuate spans are parallel to each other and separated by a constant radial distance therebetween.

5. The marine propulsion system of claim 3 wherein said outer arcuate span is longer than said inner arcuate span.

6. The marine propulsion system of claim 3 wherein said inner and outer arcuate spans subtend the same angle about said axis.

7. The marine propulsion system of claim 1 wherein:

said rotatable first hole comprises a first arcuate segment of an annulus around said axis, said first arcuate segment having a first inner arcuate span and a first outer arcuate span, said first outer arcuate span being spaced radially outwardly of said first inner arcuate span;

said stationary second hole comprises a second arcuate segment of said annulus around said axis, said second arcuate segment having a second inner arcuate span and a second outer arcuate span, said second outer arcuate span being spaced radially outwardly of said second inner arcuate span;

said second outer arcuate span is longer than said first outer arcuate span;

said second inner arcuate span is longer than said first inner arcuate span.

8. The marine propulsion system of claim 7 wherein:

said first outer arcuate span is axially aligned with said second outer arcuate span and arcuately translatable therealong upon rotation of said rotatable plate about said axis;

said first inner arcuate span is axially aligned with said second inner arcuate span and arcuately translatable therealong upon rotation of said rotatable plate about said axis.

9. A marine propulsion system, comprising:

a driveshaft;

a torque transmitting structure disposable within a bilge of a marine vessel and connectable in torque transmitting relation with an engine, said engine having a crankshaft which is supported for rotation about a first generally horizontal axis;

a housing configured to support said driveshaft for rotation about a generally vertical axis, said housing being rotatably attached to said torque transmitting structure and to a submerged bottom surface of a marine vessel with said driveshaft extending through said submerged bottom surface;

a propeller shaft, said housing being configured to support said propeller shaft for rotation about a second generally horizontal axis, said driveshaft being disposed in torque transmitting relation with said propeller shaft;

an exhaust gas passageway comprising an exhaust conduit which is connectable in fluid communication with said engine, a cavity within said housing, an exhaust passage connected in fluid communication between said exhaust conduit and said cavity and an exhaust channel connected in fluid communication with said cavity and disposed within said housing to direct exhaust gas out of said housing; and a first propeller attached to said propeller shaft for rotation about said second generally horizontal axis and configured to provide a thrust toward said housing when said marine vessel is being propelled in a forward direction, wherein:

said exhaust passage comprises a stationary plate attached to said exhaust conduit and a rotatable plate attached to said housing for rotation with said housing relative to said stationary plate, said rotatable plate having a rotatable first hole extending therethrough, said stationary plate having a stationary second hole extending therethrough, said first and second holes being shaped to remain in at least partially overlapping relation with each other when said housing rotates relative to said marine vessel;

said rotatable plate has a first rotated position in which said rotatable first hole is entirely overlapped by said stationary second hole, and has a second rotated position in which said rotatable first hole is only partially overlapped by said stationary second hole.

10. The marine propulsion system of claim 9 wherein said stationary second hole has nonoverlapped portions relative to said rotatable first hole in each of said first and second rotated positions of said rotatable plate.

11. The marine propulsion system of claim 10 wherein exhaust is blocked from exiting the interface of said rotatable and stationary plates in said second rotated position of said rotatable plate.

12. The marine propulsion system of claim 10 wherein exhaust flow is limited to only the area of overlap of said holes.

13. The marine propulsion system of claim 9 wherein said stationary second hole is larger than said rotatable first hole.

14. The marine propulsion system of claim 13 wherein said stationary second hole comprises an arcuate segment of an annulus around said axis, said arcuate segment having an inner arcuate span and an outer arcuate span, said outer arcuate span being spaced radially outwardly of said inner arcuate span.

15. The marine propulsion system of claim 14 wherein said inner and outer arcuate spans are parallel to each other and separated by a constant radial distance therebetween.

16. The marine propulsion system of claim 14 wherein said outer arcuate span is longer than said inner arcuate span.

17. The marine propulsion system of claim 14 wherein said inner and outer arcuate spans subtend the same angle about said axis.

18. The marine propulsion system of claim 13 wherein:

said rotatable first hole comprises a first arcuate segment of an annulus around said axis, said first arcuate segment having a first inner arcuate span and a first outer arcuate span, said first outer arcuate span being spaced radially outwardly of said first inner arcuate span;

said stationary second hole comprises a second arcuate segment of said annulus around said axis, said second arcuate segment having a second inner arcuate span and a second outer arcuate span, said second outer arcuate span being spaced radially outwardly of said second inner arcuate span;

said second outer arcuate span is longer than said first outer arcuate span;

said second inner arcuate span is longer than said first inner arcuate span.

19. The marine propulsion system of claim 18 wherein:

said first outer arcuate span is axially aligned with said second outer arcuate span and arcuately translatable therealong upon rotation of said rotatable plate;

said first inner arcuate span is axially aligned with said second inner arcuate span and arcuately translatable therealong upon rotation of said rotatable plate about said axis.

20. A marine propulsion system, comprising:

a driveshaft;

a housing configured to support said driveshaft for rotation about a generally vertical axis, said housing being rotatably attached to a submerged bottom surface of a marine vessel with said driveshaft extending through said submerged bottom surface;

a propeller shaft, said housing being configured to support said propeller shaft for rotation about a generally horizontal axis, said driveshaft being disposed in torque transmitting relation with said propeller shaft;

an exhaust conduit which is connectable in fluid communication with an engine which has a generally horizontal crankshaft;

a stationary plate attached to said exhaust conduit;

a rotatable plate attached to said housing for rotation with said housing relative to said stationary plate, said rotatable plate having a first hole extending therethrough, said stationary plate having a second hole extending therethrough, said first and second holes being shaped to remain in at least partially overlapping relation with each other when said housing rotates relative to said marine vessel;

a cavity within said housing;

an exhaust channel connected in fluid communication with said cavity and disposed within said housing to direct exhaust gas out of said housing; and a bearing support structure disposed within said housing and shaped to define said exhaust channel, said bearing support structure comprising a bearing carrier turning exhaust gas from a downward flow direction to a rearwardly directed horizontal direction.

21. The marine propulsion system of claim 20, wherein:

an exhaust gas passageway is defined by said exhaust conduit, said stationary plate, said rotatable plate, said cavity and said exhaust channel to direct exhaust gas from an engine and through said housing;

said rotatable plate has a first rotated position in which said rotatable first hole is entirely overlapped by said stationary second hole, and has a second rotated position in which said rotatable first hole is only partially overlapped by said stationary second hole;

said stationary second hole has nonoverlapped portions relative to said rotatable first hole in each of said first and second rotated positions of said rotatable plate;

wherein exhaust is blocked from exiting the interface of said rotatable and stationary plates in said second rotated position of said rotatable plate;

wherein exhaust flow is limited to only the area of overlap of said holes;

wherein said stationary second hole is larger than said rotatable first hole;

wherein said stationary second hole comprises an arcuate segment of an annulus around said axis, said arcuate segment having an inner arcuate span and an outer arcuate span, said outer arcuate span being spaced radially outwardly of said inner arcuate span;

wherein said inner and outer arcuate spans are parallel to each other and separated by a constant radial distance therebetween;

wherein said outer arcuate span is longer than said inner arcuate span;

wherein said inner and outer arcuate spans subtend the same angle about said axis;

wherein said rotatable first hole comprises a first arcuate segment of an annulus around said axis, said first arcuate segment having a first inner arcuate span and a first outer arcuate span, said first outer arcuate span being spaced radially outwardly of said first inner arcuate span;

said stationary second hole comprises a second arcuate segment of said annulus around said axis, said second arcuate segment having a second inner arcuate span and a second outer arcuate span, said second outer arcuate span being spaced radially outwardly of said second inner arcuate span;

said second outer arcuate span is longer than said first outer arcuate span;

said second inner arcuate span is longer than said first inner arcuate span;

wherein said first outer arcuate span is axially aligned with said second outer arcuate span and arcuately translatable therealong upon rotation of said rotatable plate;

said first inner arcuate span is axially aligned with said second inner arcuate span and arcuately translatable therealong upon rotation of said rotatable plate about said axis.

* * * * *